United States Patent [19]

Stewart

[11] Patent Number: 4,764,994

[45] Date of Patent: Aug. 23, 1988

[54] PORTABLE TOILET

[75] Inventor: John M. Stewart, Ontario, Canada

[73] Assignee: Sanitation Equipment Limited, Concord, Canada

[21] Appl. No.: 777,650

[22] Filed: Sep. 19, 1985

[51] Int. Cl.[4] ..... E03D 1/00

[52] U.S. Cl. ..... 4/321

[58] Field of Search ..... 4/317, 321, 323, 347, 4/348, 322; 215/307; 220/85 R, DIG. 27, 373; 251/149.6, 324, 325; 128/203.12

[56] References Cited

U.S. PATENT DOCUMENTS

| | | | |
|---|---|---|---|
| 2,606,736 | 8/1952 | Ferm | 251/325 x |
| 2,700,982 | 2/1955 | Fuentes et al. | 251/325 X |
| 2,753,069 | 7/1956 | Meester | 215/307 X |
| 3,747,130 | 7/1973 | Sargent et al. | 4/321 |
| 4,058,120 | 11/1977 | Caparelli et al. | 128/203.12 |

*Primary Examiner*—Charles E. Phillips

*Attorney, Agent, or Firm*—Rogers, Bereskin & Parr

[57] ABSTRACT

A portable toilet of the type having a waste holding tank which is separable from a bowl unit of the toilet. The tank includes a vent for permitting entry of air to the holding tank during emptying thereof. This avoids surging of the contents of the tank during emptying, assuring a smooth flow of the liquid and minimizing splashing. In a preferred embodiment, the vent takes the form of a sleeve projecting upwardly from the holding tank and defining a vent passageway, and a cap on the sleeve which can be manually raised to open the vent passageway but which is automatically depressed to close the vent when the bowl unit is secured to the holding tank.

5 Claims, 4 Drawing Sheets

PORTABLE TOILET

BACKGROUND OF THE INVENTION

1. Field of the Invention

This invention relates generally to portable toilets of the type including a bowl unit and a waste holding tank adapted to be detachably secured together with the bowl unit supported on the holding tank.

Typically, the bowl unit has a bowl with an outlet which communicates with an inlet at the top of the holding tank. The holding tank is provided with a valve mechanism which normally closes the inlet but which can be opened to allow waste to enter the holding tank from the bowl. The holding tank also has an outlet which is normally closed, for example by a screw cap, and through which waste can be emptied from the holding tank after the tank has been detached from the bowl unit. The holding tank is designed to be readily portable for this purpose.

A practical problem sometimes encountered in emptying the holding tank is that the waste material may not flow smoothly from the holding tank outlet because the flow of waste material tends to fill or largely obstruct the outlet at least periodically during the emptying cycle. As a result, partial vacuums are intermittently created above the liquid in the holding tank and tend to cause surging or other irregularies in the flow from the tank. This can result in objectionable splashing of the liquid being poured from the tank.

2. Description of the Prior Art

European Patent Application No. 83303054.7 of Thetford Corporation published Dec. 7, 1983 under publication No. 0 095 903 A2 discloses a portable toilet having a manually operable vent valve in the top wall of the holding tank for venting the "head space" of the holding tank during emptying. The valve disclosed in the patent application is spring-biassed to a normally closed position and has an actuator button that must be depressed to hold the valve open against the effect of its spring biassing. In order to be effective, the valve must be held open throughout the operation of emptying the holding tank. A full tank can be quite heavy and the action required to hold the valve open while manipulating the tank to empty its contents is awkward to perform.

An object of the present invention is to provide a portable toilet having an improved vent means.

SUMMARY OF THE INVENTION

The invention provides a portable toilet including a bowl unit and a waste holding tank which are adapted to be detachably secured together with the bowl unit supported on the tank. The holding tank has a closable outlet through which waste can be emptied from the tank after it has be detached from the bowl unit and vent means operable to permit entry of air into the holding tank during emptying. The vent means is provided on portions of the bowl unit and holding tank which are opposed to one another when the unit and tank are secured together. The vent means takes the form of a valve element on the holding tank defining a vent passageway between the interior of the holding tank and ambient air, and means adapted to automatically close the vent passageway when the bowl unit and holding tank are secured together.

In a simple form of the invention the passageway in the valve element could be an opening that is closed when the bowl unit and holding tank are secured together, and opened simply by separation of the bowl unit and holding tank. However, the valve element preferably includes a valve member which is manually displaceable between a first position in which the passageway is closed by the valve member, and a second position in which the passageway is open, permitting air flow therealong. In this event, the valve member is preferably arranged to project from the valve element in its second (open) position and to be depressed to its first (closed) position upon interengagement of the bowl unit and holding tank. In a preferred embodiment, the valve element will project from the holding tank into a recess on the bowl unit and the valve member will be depressed towards its closed position by contact with the bottom of the recess.

BRIEF DESCRIPTION OF THE DRAWINGS

In order that the invention may be more clearly understood, reference will now be made to the accompanying drawings which illustrate preferred embodiments of the invention by way of example, and in which.

DESCRIPTION OF THE PREFERRED EMBODIMENTS

Figure 1:
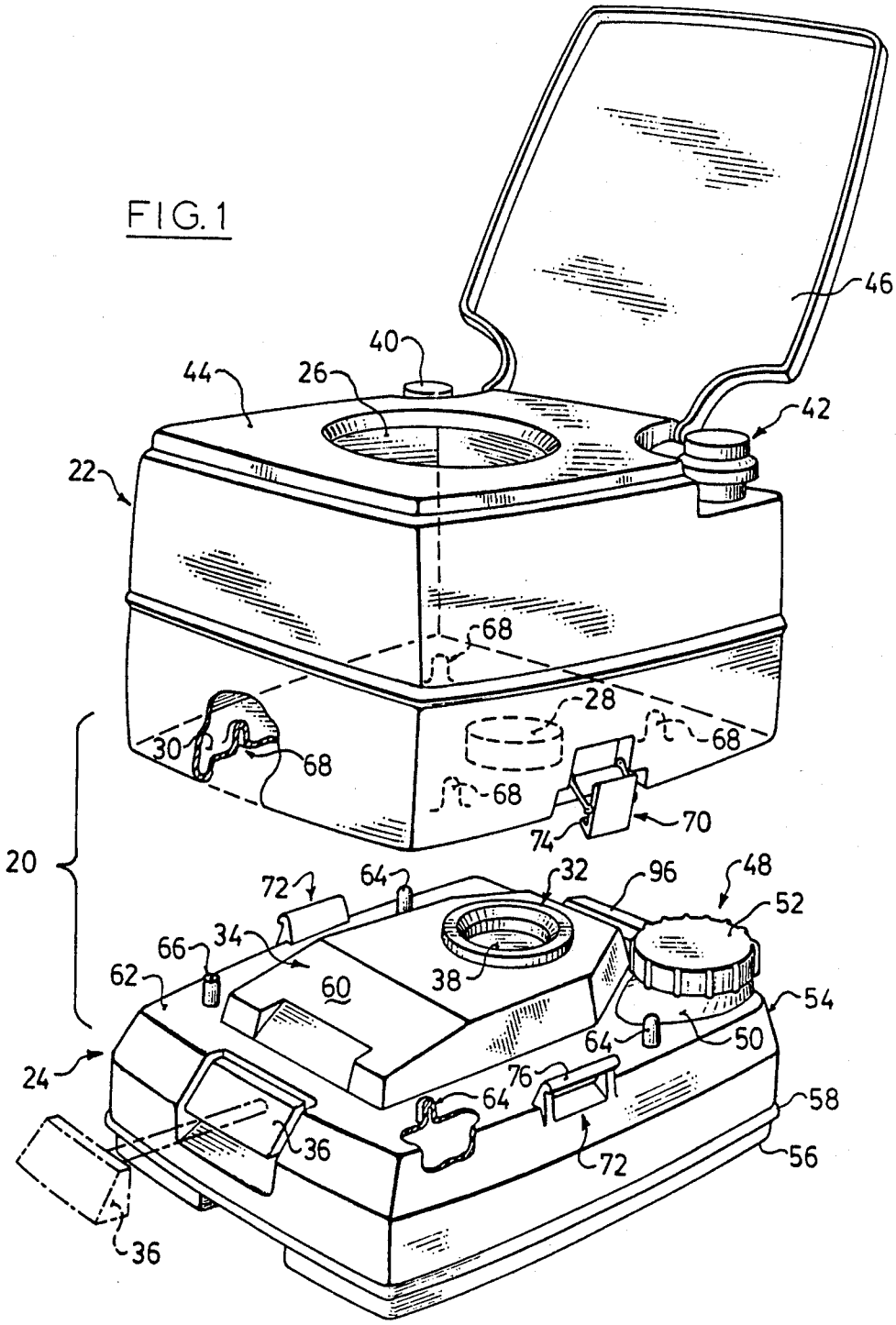
FIG. 1 is a perspective view of a portable toilet in accordance with the invention with the bowl unit shown in an exploded position above the holding tank.

Referring first to FIG. 1, a portable toilet 20 is shown to comprise a bowl unit 22 and a holding tank 24 and may be generally of the form disclosed in Canadian Pat. No. 1,157,207 issued Nov. 22, 1983 to Sanitation Equipment Limited. Reference may be made to that patent for a detail description of the bowl unit and holding tank. For present purposes, it is sufficient to note that the bowl unit and holding tank are adapted to be detachably secured together with the bowl unit supported on the holding tank; for purposes of illustration, the bowl unit is shown in an exploded position above the holding tank. The bowl unit includes a toilet bowl, part of which is visible at 26 in FIG. 1. The bowl has an outlet shown in dotted outline at 28 in a bottom wall 30 of the bowl unit, and the outlet co-operates with an inlet 32 of the holding tank when the bowl unit is seated on the holding tank so that waste can be flushed into the holding tank at appropriate times.

Entry of waste into the holding tank is controlled by a valve assembly generally indicated by reference numeral 34. The valve assembly is controlled by a handle 36 at the front of the holding tank which can be pulled outwardly as indicated in ghost outline to open a valve member 38 below inlet 32. Details of the valve mechanism are not given here because they form no part of the present invention. Reference may be had to Canadian Pat. No. 1,046,705 issued Feb. 20, 1979 to Sanitation Equipment Limited for details of the valve assembly. The bowl unit also includes a reservoir (not shown) for flushing liquid and is provided with a manually operable pump 40 for delivering flushing liquid from the reservoir into the bowl. A cap covering an inlet through which the reservoir can be replenished is indicated by reference numeral 42. The bowl unit is also provided with a lift up seat 44 surrounding the bowl and a lid 46. Again, reference may be had to the Canadian patents identified above for a detail description of these parts.

Holding tank 24 is also provided with a closable outlet generally indicated at 48 through which waste can be emptied from the holding tank after the tank has been detached from the bowl unit. The outlet takes the form of an externally screw-threaded cylindrical neck, part of which is visible at 50 shown in FIG. 1, fitted with a screw cap 52. Both the holding tank and the bowl unit are assembled from a number of plastic mouldings. The holding tank itself is made up of upper and lower mouldings denoted respectively 54 and 56 sealed together at a joint line 58. The upper moulding 54 includes the neck for outlet 48 and a raised portion 60 forming a housing for the valve mechanism. Surrounding that portion is a generally flat area 62 on which the bowl unit seats when the bowl unit and holding tank are assembled. The bottom wall 30 of the bowl unit is contoured to be generally complimentary to the contour of the top wall of the holding tank so that the bowl unit will sit firmly on the holding tank, all generally as described in the Canadian patents referred to above.

Four generally cylindrical projections extend upwardly from the flat area 62 at the top of the holding tank and are received in complimentary recesses in the bottom wall 30 of the bowl unit. These projections and recesses assure proper alignment of the bowl unit on the holding tank when the toilet is assembled. In FIG. 1, three of the projections are denoted by reference numeral 64 and take the form of plain hollow formations in the plastic moulding 54 forming the top of the holding tank. Part of moulding 54 has been broken away to show one of these projections. Each projection 64 has a generally hemispherical top.

Figure 2:
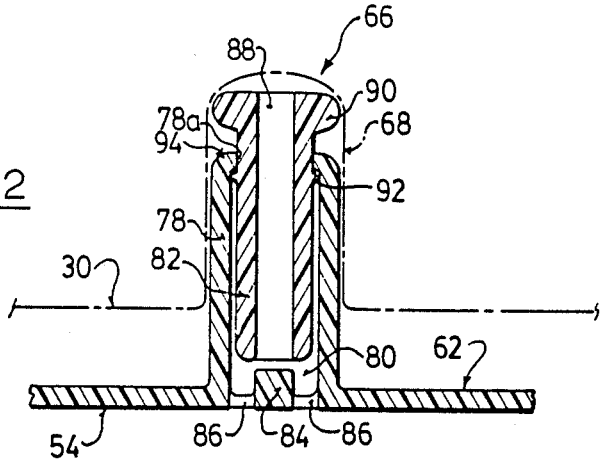
FIG. 2 is a vertical sectional view through the vent means of the toilet of FIG. 1 according to one embodiment of the invention.
Figure 3:
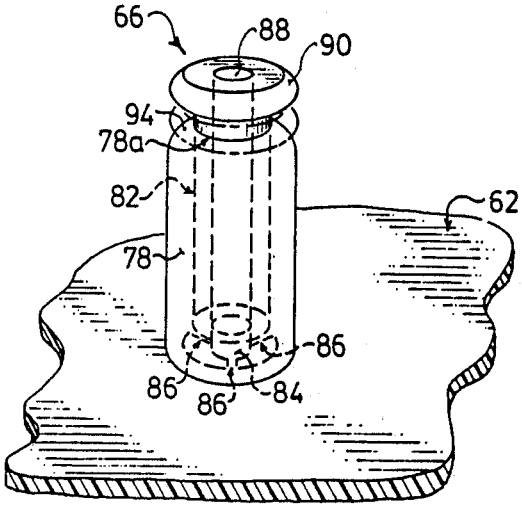
FIG. 3 is a perspective view of part of the vent means shown in FIG. 2.
Figure 4:
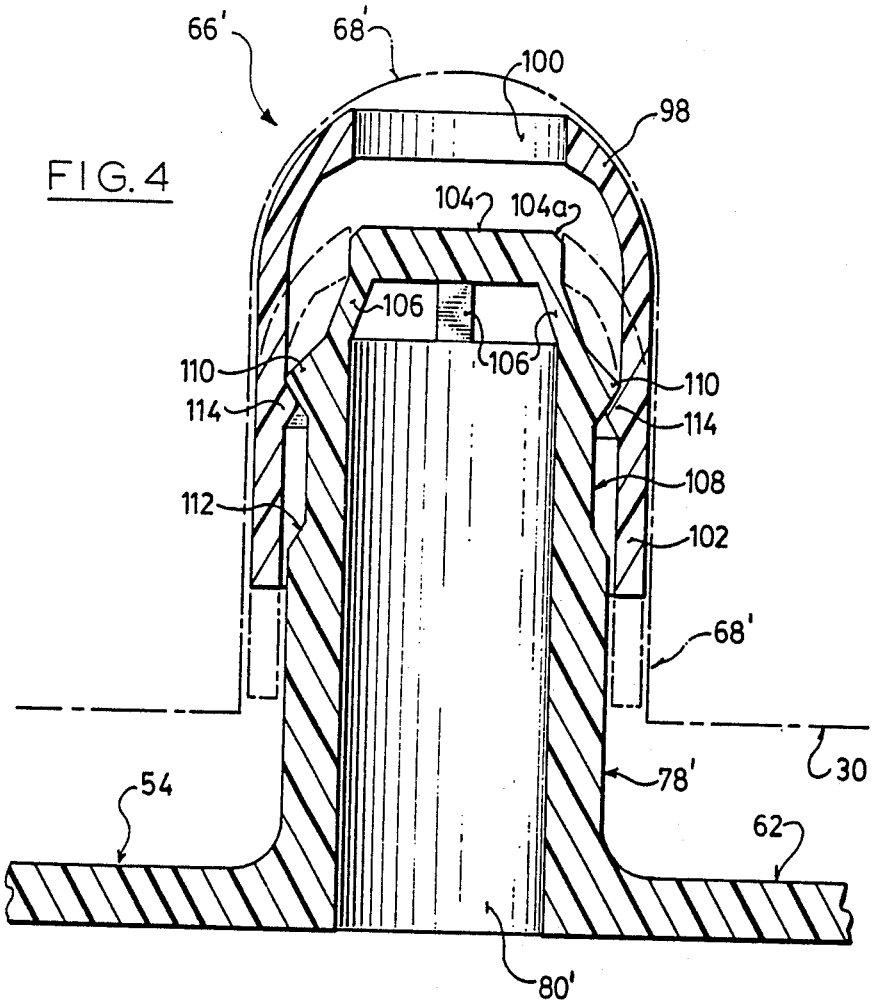
FIG. 4 is a vertical sectional view through vent means according to a further embodiment of the invention; and, FIGS. 5 and 6 are side elevational and plan views respectively of part of the vent means of FIG. 4.
Figure 6:
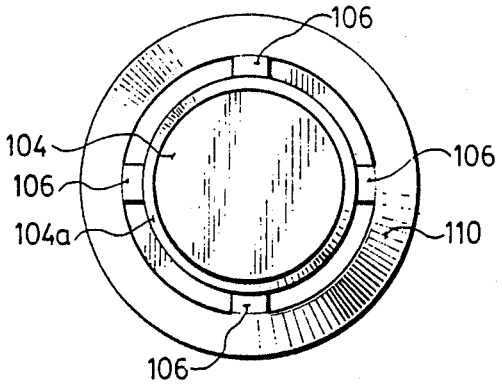
Figure 5:
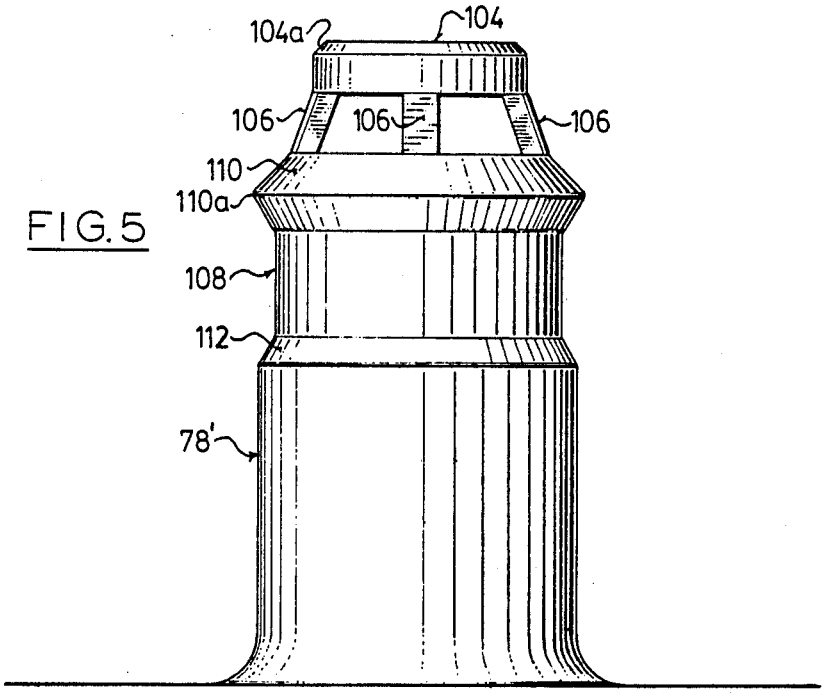

The fourth projection, at the front left side of the holding tank as seen in FIG. 1 is denoted by reference numeral 66 and has essentially the same profile as the other projections 64; however, this projection takes the form of a hollow sleeve fitted with a valve member (as will be described) and is designed to provide vent means operable to permit entry of air into the holding tank during emptying thereof. Details of the vent means will be given later particularly with reference to FIGS. 2 to 6; FIGS. 2 and 3 illustrate a form of vent means according to one embodiment of the invention, while FIGS. 4 to 6 show an alternative form, according to a further embodiment.

The bottom wall 30 of bowl unit 22 incorporates four recesses 68 positioned to receive the projections 64 and 66. The four recesses are essentially identical and a portion of the bowl unit has been broken away to show one of these recesses as typical of all four. Thus, each recess is defined by an inwardly directed formation in the bottom wall 30 of the bowl unit and is of cylindrical shape with a domed portion at the bottom of the recess. Each recess is dimensioned to closely receive the corresponding projection 64 or 66 so that there is only sufficient clearance to permit the projection to enter the recess without allowing significant lateral movement between the bowl unit and holding tank. In this way, the projections and recesses assure correct alignment of the bowl unit on the holding tank. The projections also penetrate to the full depths of the respective recesses.

A pair of latches at opposite sides of the bowl unit, one of which is shown at 70, engage corresponding keepers 72 on the holding tank for detachably securing the bowl unit and holding tank together. Each latch 70 is pivotally coupled to the bowl unit and has a nose 74 for engagement below a bar formation 76 of keeper 72 when the bowl unit is on the holding tank. The top portion of latch 70 is then pressed inwardly and the latch snaps over-center to lock the bowl unit and holding tank together. Obviously, the latches can be released in reverse fashion simply by prising the tops of the latches outwardly until the latch again goes over-center and the latch is released.

Reference will now be made to FIGS. 2 and 3 in describing a first embodiment of the invention.

In FIG. 2, the projection 66 of FIG. 1 is shown in vertical section while FIG. 3 shows that projection in perspective. FIG. 2 also shows part of the bottom wall 30 of the bowl unit including the recess 68 intended to receive projection 66. Part of the moulding forming the top of the holding tank is also shown at 54.

Projection 66 includes a hollow generally cylindrical formation or sleeve 78 in the top wall of moulding 54. Sleeve 78 is hollow and has a circular opening **78*a* at its top, thereby providing a vent passageway 80 between the interior of the waste holding tank and ambient air. A poppet valve member 82 and a co-operating seal 84 are provided within sleeve 78 for the purpose of closing vent passageway 80 at appropriate times. Seal 84 takes the form of a plug disposed generally centrally of passageway 80 and connected to moulding 54 by three spaced webs (see FIG. 3). Valve member 82 is designed to be movable vertically in sleeve 78 between the raised position in which it is shown in FIG. 2 and in which passageway 80 is open, and a depressed position in which the passageway is closed. This is achieved by providing a central longitudinal passageway 88 through valve member 82 and arranging for the lower end of the passageway to be plugged by seal 84** when the valve member is in its depressed position.

As can perhaps best be seen in FIG. 3, valve member 82 is of hollow cylindrical form with the passageway 88 extending from end to end thereof, and has an enlarged annular head 90 at its upper end. This head is of the same external diameter as the formation 66 and is profiled to generally follow the domed profile of the other projections 64 (FIG. 1) at the top of the holding tank. In addition, a thin and relatively flexible ring or rib 92 encircles valve member 82 at a spacing below head 90 and frictionally engages the wall of passageway 80 so that the valve member tends to be frictionally retained in a position to which it is moved. Rib 92 also acts as a stop for limiting movement of the valve member upwardly away from the holding tank. As can best be seen in FIG. 2, rib 92 co-operates with an inturned annular lip 94 at the top of formation 66, surrounding opening **78*a*. Valve member 82 is shown substantially at the limit of its upward movement with rib 92 almost in contact with lip 94. It will be understood that, if the valve member 82 is depressed from the position shown in FIG. 2, seal 84 will enter the lower end of the passageway 88 through the valve member so that the valve member and seal will effectively close the vent passageway 80. Abutment of head 90 with the top of sleeve 78** limits downward movement of the valve member.

Valve member 82 is a one-piece moulding in a plastic material (for example polyethylene). Similarly, the mouldings 54 and 56 from which the holding tank is made are also plastic (for example polypropylene). The inherent flexibility of these mouldings permits valve member 82 to be assembled into sleeve 78 by pressing the valve member downwardly so that the rib 92 snaps through opening 78 as a result of temporary resilient deformation of the rib 92 and/or lip 94. Once installed, co-operation between the rib 92 and the lip 94 will prevent removal of the valve member under normal operating conditions of the toilet.

As discussed previously, the recesses 68 in the bottom wall of the bowl unit 22 (FIG. 1) are each dimensioned to closely receive the relevant projection 64, 66. In the case of projection 66, the overall height of the top of the valve member 82 above the flat surface area of the holding tank when the valve member is in the open position shown in FIG. 2 is greater than the depth of the corresponding recess 68 and the depth of that recess is selected to correspond substantially exactly to the height of the valve member in its closed position. Accordingly, if the valve member is left open and the bowl unit is fitted onto the holding tank, the top of the valve member 82 will seat fully within the associated recess 68 as indicated in FIG. 2 and as soon as the bowl unit is depressed and locked to the holding tank, the valve member will automatically be closed by virtue of its contact with the bottom of the recess 68. This ensures that the vent can never accidentally be left open, which could lead to spillage of liquid from the holding tank and/or escape of undesirable odours from the tank.

When the toilet is in use, and the holding tank requires emptying, the bowl unit is first detached from the holding tank by operating latch 70 and the corresponding latch at the opposite side of the tank and the bowl unit is lifted off the tank. The user then carries the holding tank to a disposal site for emptying. A handle which is partly visible at the rear of the holding tank in FIG. 1 and is designated by reference numeral 96 is integrally moulded into the holding tank to assist in carrying. At the disposal site, the waste outlet cap 52 is removed and the vent is opened by pulling up on the head 90 of the poppet valve member 82, bringing the valve member to the position in which it is shown in FIG. 2. Vent passageway 80 is then open. The holding tank is then tipped by raising the front end of the tank (the end at which the flush handle 36 appears) and waste will flow out of the outlet 50 while air flows in through passageway 80. This venting of the tank assures smooth outflow of liquid therefrom. When the tank has been emptied and cleaned if necessary, the cap 52 is replaced. Valve member 82 can then be manually depressed to close the vent passageway 80 or the valve member can be left open until the bowl unit is again seated on the holding tank when the valve member will automatically be closed by seating in the associated recess 68 in the bottom wall of the holding tank, as described above.

Reference will now be made to FIGS. 4, 5 and 6 in describing vent means according to a further embodiment of the invention. Primed reference numerals will be used in those views to denote parts corresponding to parts shown in the previous views.

The vent means shown in FIGS. 4, 5 and 6 differs from the vent means of FIGS. 2 and 3 primarily in that the internal valve member 82 in FIGS. 2 and 3 has been replaced by a valve member in the form of an external cap denoted by reference numeral 98 in FIG. 4. The cap fits over a generally cylindrical sleeve 78' which projects upwardly from the flat area 62 at the top of the holding tank 24. As can be seen from FIGS. 5 and 6, sleeve 78' is generally of cylindrical shape overall. Cap 98 is also generally cylindrical but has a domed top shaped to fit within one of the recesses 68 at the underside of the bowl unit 22 of the toilet and formed with a circular vent opening 100. The cap also has a skirt 102 which surrounds and frictionally grips sleeve 78' as well as forming a liquid seal therewith as will be described.

Sleeve 78 defines an internal vent passageway 80' which communicates with the interior of the waste holding tank. At the upper end of the sleeve a plug member 104 extends transversely of passageway 80' and is supported about sleeve 78' by four equally spaced legs 106 extending between the sleeve and the plug member, as best seen in FIGS. 5 and 6.

Plug member 104 is generally disc-shaped with a chamfered edge **104*a* around its top surface and is dimensioned to fit within and seal the opening 100 in cap 98. As shown in FIG. 4, cap 98 is in a raised position in which the passageway 80' in sleeve 78' provides communication between the interior of the waste holding tank and ambient air. Cap 98 can also be depressed from the position in which it is shown in FIG. 4 to a position in which plug member 104 fits within and seals the opening 100 in the cap. This position of the cap member is indicated in ghost outline in FIG. 4 and it will be seen that the top surface of plug member 104 lies generally flush with the top of cap 98** at this time.

The portion of the external surface of sleeve 78' which is surrounded by the skirt 102 of cap 98 includes a "waist" area 108 extending between upper and lower shoulders 110 and 112 respectively. It will be seen that the lower shoulder 112 is defined by a straight chamfer while the upper shoulder 110 is radiussed at **110*a* (FIG. 5) to define a protuberant rib which frictionally engages the internal surface of the skirt 102. As best seen in FIG. 4, a similar but oppositely directed rib 114 extends around the interior surface of skirt 102 and engages below the rib 110 on the sleeve 78' when cap 98 is in its raised (open) position. When the cap is depressed, rib 114 engages shoulder 112 and defines the "vent-closed" position of the cap. In other words, the co-operating ribs 110, 114 and shoulder 112 serve to define the extent to which cap 98 can be moved up and down between the vent-open and vent-closed positions. Frictional engagement between the respective ribs 110, 114 also serves to hold the cap 98 in a position to which it is moved with respect to sleeve 78'**.

The two ribs 110, 114 additionally provide two annular seal areas between sleeve 78' and cap 98 in the depressed (closed) position of cap 98. As discussed previously, in the depressed position of cap 98, plug member 104 seals within the opening 100 in the cap preventing accidental leakage of liquid or gas from passageway 80' to ambient air through opening 100. In addition, the ribs 110, 114 provide respective seals between the skirt 102 of cap 98 and sleeve 78' to guard against a possibility of leakage downwardly through skirt 102.

As in the previous embodiment, sleeve 78' is moulded integrally with the moulding 54 that forms the top of the waste holding tank 24. Cap 98 is also a one-piece plastic moulding.

The vent means of FIGS. 4, 5 and 6 operates in essentially similar fashion to the vent means described previously. When the bowl unit and holding tank have been separated, the valve member of the vent means (cap 98)

is manually raised to the position shown in FIG. 4 and remains in that position during emptying of the tank. Air can then enter through cap opening 100, flow between the legs 106 below plug member 104, and from there into the waste holding tank via passageway 80'. At the end of the emptying operation, cap 98 is depressed to cause plug member 104 to seal within opening 100 and close vent passageway 80'.

Cap 98 will be automatically depressed to close passageway 80' when the bowl unit 22 and waste holding tank 24 of the toilet are fitted together, by virtue of the engagement of cap 98 within the association recess 68' at the underside of the bowl unit, generally as described previously. In other words, cap 98 is fully seated within the associated recess 68' and in its depressed position when the bowl unit and holding tank are coupled together.

In summary, the vent means of the respective embodiments operate in essentially similar fashion except in the embodiments of FIGS. 2 and 3, the valve member of the vent means slides internally within the vent passageway while in the embodiment of FIGS. 4 to 6, the valve member takes the form of an external cap. It is believed that the two forms of vent means will be functionally similar although the form shown in FIGS. 4 to 6 may be preferred in terms of ease of manufacture.

It will of course be appreciated that the preceding description relates to particular preferred embodiments of the invention only and that many modifications are possible within the broad scope of the invention. For example, the vent means provided by the invention need not be incorporated in an alignment formation on the holding tank but could be provided separately. In a simple embodiment, the valve element on the holding tank need not incorporate a valve member but the vent passageway could simply be closed by a portion of the bowl unit (for example a portion defining a plug fitting into the passageway) when the bowl unit is seated on the holding tank. However, this arrangement would not be preferred because the vent means would then be open at all times when the bowl unit is not seated on the holding tank. Another possibility would be to in effect reverse the arrangement illustrated and provide a male element on the bowl unit that would engage in an opening or a female recess in the holding tank. The recess or opening could be closed directly by the male element on the bowl unit or that element could actuate a valve member, similar to valve member 82.

Where a movable valve member is provided, the member is preferably manually movable between a first position in which the vent passageway is closed and a second position in which the passageway is open, and is positively retained in each position. This avoids the problem of the prior art discussed above where the valve member must be held open durig the entire holding tank emptying operation. However, the valve member need not be of the exact form shown. For example, the valve member could be arranged to open and close vent openings in the side of sleeve 78 or 78' to open and close the vent passageway.

I claim:

1. A portable toilet including a bowl unit and a waste holding tank adapted to be detachably secured together with the bowl unit supported on the holding tank, wherein the holding tank has a closable outlet through which waste can be emptied from the holding tank after the tank has been detached from the bowl unit, and vent means operable to permit entry of air into the holding tank during emptying thereof;

wherein said vent means comprises a sleeve extending upwardly from the holding tank and defining a vent passageway extending between the interior of the holding tank and ambient air and a valve member slidably coupled to said sleeve for movement between a first position in which the vent passageway is closed and the valve member is in a depressed position with respect to the sleeve, and a second position in which the valve member is extended with respect to the sleeve and the said vent passageway is open, the valve member being manually movable between its said first and second positions and being retained in a position to which it has been moved, the valve member being arranged so that it is automatically moved to its said first position by contact with the bowl unit if the bowl unit is coupled to the holding tank when the valve member is in its second position said valve member comprising a cap retained on said sleeve for sliding movement in the axial direction thereof between its said first and second positions, the cap including an opening which provides communication between said vent passageway and ambient air in the second position of the valve member, and which is closed when the cap is in its said first position wherein said cap has a top wall and a depending annular skirt slidably coupled to said sleeve, said opening being provided in said top wall of the cap and said sleeve being provided with a plug member within said cap for closing said opening, the plug member being coupled to the sleeve at a spacing from an upper end thereof so as to permit air to flow between the vent passageway and the interior of the cap and the plug member being arranged to engage in and seal the opening when the cap is in its said first position, the skirt of the cap sealingly engaging the sleeve so as to prevent leakage through the skirt in the closed position of the cap.

2. A portable toilet as claimed in claim 1, further comprising alignment means including a series of projections extending upwardly from the holding tank and engaging complimentary recesses on the bowl unit, said projections and recesses being adapted to prevent significant lateral movement between the bowl unit and holding tank, thereby assuring alignment between these components, wherein said sleeve and valve member define one of said projections and are received in a complimentary said recess in the bowl unit when the bowl unit and holding tank are coupled together, the valve member being moved to its said first position by contact with the bottom of said recess.

3. A portable toilet as claimed in claim 1, wherein said plug member is coupled to said sleeve by a plurality of spaced legs extending between the plug member and the sleeve, between which air can flow between the vent passageway and the interior of the cap.

4. A portable toilet as claimed in claim 1, wherein said seal between the skirt of the cap and the sleeve is provided by an external annular rib on the sleeve and a corresponding inwardly directed annular rib on the skirt engaging below the rib on the sleeve, the respective ribs slidably sealing against plain surface portions of the respective skirt and sleeve as the cap is moved between its first and second positions.

5. A portable toilet as claimed in claim 4, wherein said plain surface portion of the sleeve extends between the rib on the sleeve and a shoulder below the rib, whereby the rib on the cap skirt moves between the rib and shoulder on the sleeve as the cap moves between its first and second positions, said rib and shoulder on the sleeve being spaced to define said first and second positions of the cap.

* * * * *